US007520145B2

(12) United States Patent
Hong et al.

(10) Patent No.: US 7,520,145 B2
(45) Date of Patent: Apr. 21, 2009

(54) WASHING MACHINE COMBINED WITH DRYER AND CONTROLLING METHOD THEREOF

(75) Inventors: Sog Kie Hong, Seoul (KR); Young Hwan Park, Seoul (KR)

(73) Assignee: LG Electronics, Inc., Seoul (KR)

( * ) Notice: Subject to any disclaimer, the term of this patent is extended or adjusted under 35 U.S.C. 154(b) by 513 days.

(21) Appl. No.: 11/184,288

(22) Filed: Jul. 18, 2005

(65) Prior Publication Data

US 2006/0101589 A1 May 18, 2006

(30) Foreign Application Priority Data

Nov. 12, 2004 (KR) ..... 10-2004-0092298

(51) Int. Cl.
*D06F 33/00* (2006.01)
*D06F 39/00* (2006.01)

(52) U.S. Cl. ..... 68/12.27; 68/12.21; 68/12.22; 68/20; 68/24

(58) Field of Classification Search ..... 68/12.15, 68/19, 19.1, 20, 140, 12.21, 12.22, 12.27, 68/9, 24, 207
See application file for complete search history.

(56) References Cited

U.S. PATENT DOCUMENTS 3,707,856 A * 1/1973 Niewyk et al. ..... 68/12.03
4,489,455 A * 12/1984 Spendel ..... 8/158
6,158,148 A 12/2000 Krausch
2004/0068889 A1* 4/2004 Park et al. ..... 34/446
2004/0154643 A1* 8/2004 Kim et al. ..... 134/18
2005/0204583 A1* 9/2005 Kim ..... 34/604
2005/0223755 A1* 10/2005 Hong et al. ..... 68/12.14
2006/0048405 A1* 3/2006 Baek et al. ..... 34/443
2006/0086001 A1* 4/2006 Jeong et al. ..... 34/606
2006/0101589 A1* 5/2006 Hong et al. ..... 8/158
2006/0137105 A1* 6/2006 Hong et al. ..... 8/147
2006/0162182 A1* 7/2006 Wong et al. ..... 34/486
2007/0130793 A1* 6/2007 Hada et al. ..... 34/454
2007/0220683 A1* 9/2007 Kim ..... 8/158

FOREIGN PATENT DOCUMENTS

EP 2004222763 8/2004
JP 2004-222763 8/2004

* cited by examiner

*Primary Examiner*—Michael Barr
*Assistant Examiner*—Rita R Patel
(74) *Attorney, Agent, or Firm*—Lee, Hong, Degerman, Kang & Waimey

(57) ABSTRACT

A washing machine combined with a dryer is provided. In the washing machine combined with a dryer, a tub is provided, a dryer duct is installed outside of the tub to introduce a surrounding air into the tub, a heater is installed in the dryer duct to apply heat to the surrounding air, a temperature sensor is installed in the dryer duct to measure temperature inside the tub or temperature inside the dryer duct, and a dryer fan is installed in the dryer duct to draw in the surrounding air.

14 Claims, 6 Drawing Sheets

WASHING MACHINE COMBINED WITH DRYER AND CONTROLLING METHOD THEREOF

CROSS-REFERENCE TO RELATED APPLICATIONS

Pursuant to 35 U.S.C. § 119(a), this application claims the benefit of earlier filing date and right of priority to Korean Application No. 10-2004-0092298, filed on Nov. 12, 2004, the contents of which are hereby incorporated by reference herein in their entirety.

BACKGROUND OF THE INVENTION

1. Field of the Invention

The present invention relates to a washing machine, and more particularly, to a washing machine combined with a dryer, in which a hot steam generated during a hot water washing operation is prevented from reversely flowing to the outside.

2. Description of the Related Art

A washing machine is a home appliance for washing clothes automatically. In a typical washing machine, a motor spins a drum to agitate clothes together with water containing detergent to remove dirt from the clothes.

A drum type washing machine is becoming very common. In the drum type washing machine, clothes are lifted and dropped to force water and detergent solution to pass through the clothes to remove dirt from the clothes. Since the clothes are lifted and dropped in the drum, the drum type washing machine can clearly washes the clothes while damaging the clothes less than other types of washing machines. Also, the drum type washing machine can wash more clothes at a time than other types of washing machines.

Further, a washing machine combined with a dryer is introduced to eliminate the inconvenience of using a washing machine and a dryer separately. Washing machines combined with a dryer can be classified into a condenser type and a vented type depending on a drying method.

The washing machine combined with the condenser type dryer removes residual moisture from clothes by circulating a heated air through a drum. On the contrary, the washing machine combined with the vented type dryer removes residual moisture from clothes by blowing a heated air into a drum and discharging the air to the outside through a tub and an air-vent duct. Here, the air discharged has a relatively high humidity because it has taken moisture from the clothes in the drum.

The washing machine combined with the vented type dryer is provided at an upper portion with a dryer duct in which a flower fan and a heater are installed. The blower fan draws in air from between a cabinet and a tub, and the heater applies heat to the air. An outlet of the dryer duct is connected to a drum to direct the heated air into the drum. The air takes moisture from clothes in the drum and then the air is discharged to the outside.

However, the washing machine combined with the vented dryer has a disadvantage in that a hot steam, generated during a hot water washing operation, flows reversely into the dryer duct and leaks to the outside.

That is, through an inlet of the dryer duct where the blower fan is installed, the steam reversely flows toward a space between the tub and the cabinet and discharged to the outside of the washing machine through a gap defined at a connecting portion of the cabinet, thereby increasing humidity of the room and causing problems such as mildew on the walls.

Further, the steam makes the cabinet rusted. Furthermore, when the steam infiltrates into electric components and condenses therein, it causes malfunction of electrical components and increases the possibility of a fire.

SUMMARY OF THE INVENTION

Accordingly, the present invention is directed to a washing machine combined with a dryer that substantially obviates one or more problems due to limitations and disadvantages of the related art.

An object of the present invention is to provide a washing machine combined with a dryer, in which a hot steam generated during a hot water washing operation is prevented from reversely flowing to the outside of the washing machine through a dryer duct.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine combined with a dryer includes: a tub; a dryer duct installed outside of the tub to introduce a surrounding air into the tub; a heater installed in the dryer duct to apply heat to the surrounding air; a temperature sensor installed in the dryer duct to measure temperature inside the tub or temperature inside the dryer duct; and a dryer fan installed in the dryer duct to draw in the surrounding air.

In another aspect of the present invention, a washing machine combined with a dryer includes: a temperature sensor; a dryer fan operating in accordance with temperature measured by the temperature sensor; a controller controlling the dryer fan in accordance with the temperature measured by the temperature sensor; a storage unit storing a reference temperature for determining the operation of the dryer fan; and a driving unit driving the dryer fan.

In a further another aspect of the present invention, there is provided a controlling method of a washing machine combined with a dryer, including: starting a washing operation using a hot water; measuring temperature inside a dryer duct with a temperature sensor; comparing the measured temperature with a reference temperature; operating a dryer fan depending on the comparison result; and completing the washing operation.

According to the present invention, the hot steam generated during the hot water washing operation is prevented from reversely flowing to the outside of the washing machine through the dryer duct.

Therefore, problems resulting from high humidity in room, such as mildew on walls, can be prevented.

Further, the cabinet or the tub of the washing machine can be prevented from rusting.

Furthermore, the electrical components of the washing machine can be prevented from firing and malfunctioning.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
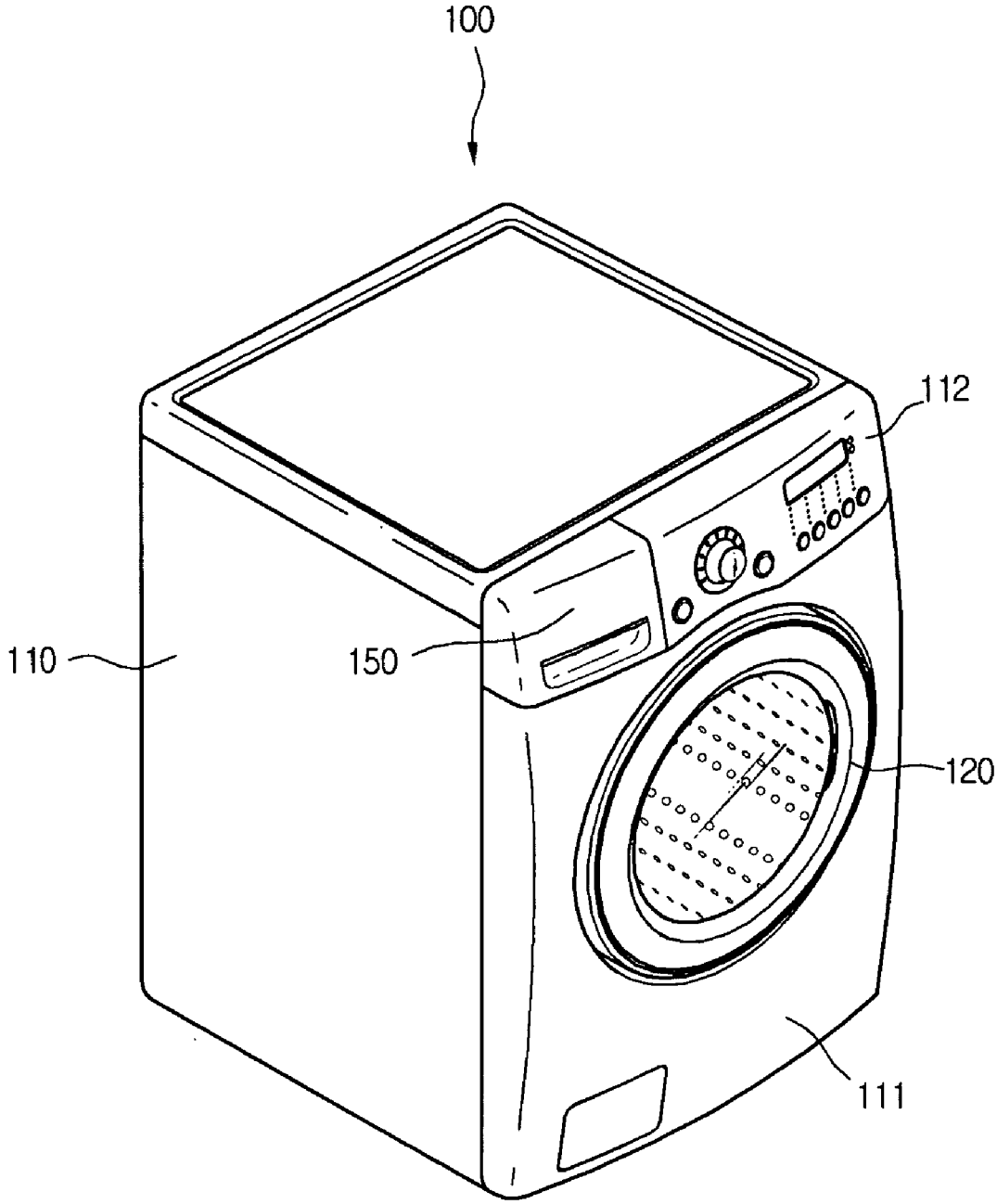
FIG. 1 is a perspective view of a washing machine combined with a vented dryer that is capable of preventing an adverse flow of steam according to the present invention.
Figure 2:
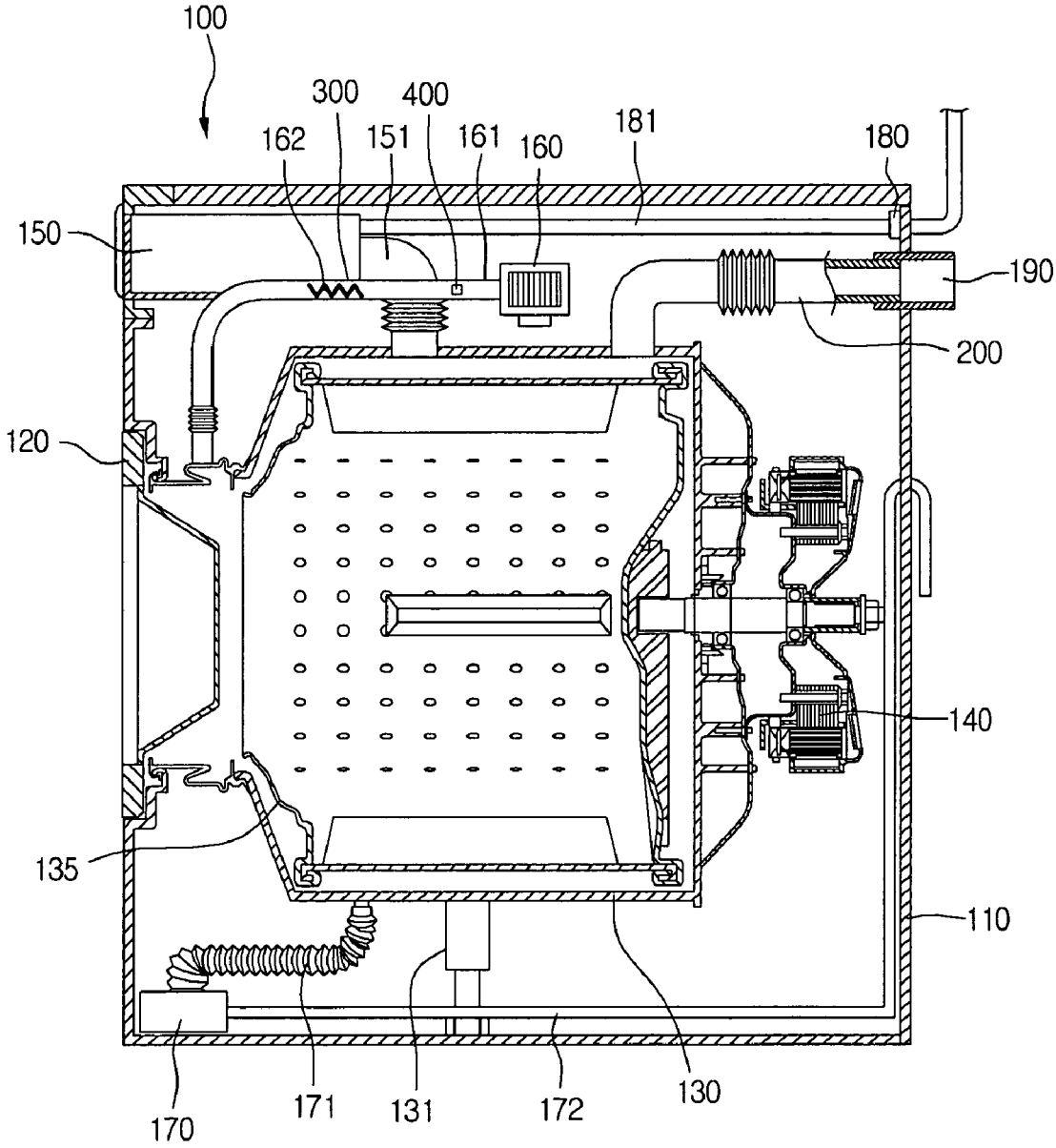
FIG. 2 is a side sectional view of the washing machine combined with the vented dryer depicted in FIG. 1.

FIG. 1 is a perspective view of a washing machine combined with a vented dryer that is capable of preventing an adverse flow of steam according to the present invention, and FIG. 2 is a side sectional view of the washing machine combined with the vented dryer depicted in FIG. 1.

Referring to FIGS. 1 and 2, a washing machine combined with a dryer 100 includes an enclosing cabinet 110, a front cover 111 installed on a front of the cabinet 110, a door 120 openable mounted at a center of the front cover 111 for loading clothes, a tub 130 installed in the cabinet 110 to receive water, and a drum 135 installed in the tub 130 to receive clothes to be washed.

Also, the washing machine combined with the dryer 100 includes a motor 140, a control panel 112, a detergent dispenser drawer 150, and a water inlet valve 180. The motor 140 is mounted on a back of the tub 130 with its shaft connected to the drum 135 to drive the drum 135, the control panel 112 is formed on an upper side of the front cover 111 with a plurality of buttons for a user to select operating conditions, the detergent dispenser drawer 150 is installed beside the control panel 112 to receive washer detergents, fabric softeners, or the like, and the water inlet valve 180 is installed on an upper rear of inside of the cabinet 110 to control the inflow of water to the detergent dispenser drawer 150.

Further, the washing machine combined with the dryer 100 includes a water inlet line 181 and a bellows 151. The water inlet line 181 connects the water inlet valve 180 and the detergent dispenser drawer 150 for the water inflow, and the bellows 151 connects the detergent dispenser drawer 150 and the tub 130 to allow the water to flow into the tub 130 after it is mixed with the wash detergents in the detergent dispenser drawer 150.

Further, the washing machine combined with the dryer 100 includes a damper 131, a drain tube 171, a drain pump 170, and a drain hose 172. The damper 131 supports the tub 130 to dampen the vibration generated when the drum 135 is rotated, the drain tube 171 is connected to a bottom of the tub 130 to drain the water contaminated during a washing operation, the drain pump 170 is connected to an end of the drain tube 171 to pump out the contaminated water, and the drain hose 172 is connected from the drain pump 170 to the outside to discharge the pumped water to the outside.

Further, the washing machine combined with the dryer 100 includes a dryer duct 300, a heater 162, a dryer fan 160, a temperature sensor 400, a connecting tub 200, and an air-vent duct 190. The dryer duct 300 introduces surrounding air into the drum 135 to start a heat drying operation after the clothes are washed, rinsed, and spin dried. The heater 162 is installed in the dryer duct 300 to heat the introduced air to a high temperature, the dryer fan 160 is installed in the dryer duct 300 to draw in the surrounding air, and the temperature sensor 400 is installed in the dryer duct 300 to measure the temperature in the dryer duct 300 during the heat drying operation. The air-vent duct 190 is installed in a rear side of the cabinet 110 and the connecting tub 200 is connected between the tub 130 and the air-vent duct 190, such that the air containing lots of moisture taken from the clothes during the heat drying operation can be discharged from the drum 135 to the outside.

An operation of the washing machine combined with the dryer 100 will now be described.

First, a user loads clothes in the drum 135 through the door 120 and fills the detergent dispenser drawer 150 with detergent or fabric softener. Then, the user selects operating conditions using the control panel 112 and presses a start button to start a washing operation.

Upon the pressing of the start button a washing operation is started, and the water inlet valve 180 is opened to introduce water from a water source to the detergent dispenser drawer 150. The introduced water is mixed with the detergent in the detergent dispenser drawer 150 and the water containing detergent (washing water) is dropped down to the tub 130 through the bellows 151 until it fills the tub 130 to a predetermined level.

When the washing water is filed in the tub 130 to the predetermined level, the water inlet valve 180 is closed, and the motor 140 is operated to drive the connected drum 135. The clothes, as the drum 135 is rotated, is lifted up and dropped down in the drum 135 to force the washing water to pass through it to remove dirt.

If the washing operation is carried out using a hot water for washing certain kinds of clothes such as white cotton clothes, hot steam flows reversely to the dryer duct 300. The reversely flowing steam is detected by the temperature sensor 400, and the dryer fan 160 is operated upon the detection of the temperature sensor 400 to prevent the steam from reversely passing through the dryer duct 300. Namely, the dryer fan 160 draws in surrounding air and blows it toward the reversely flowing steam to prevent the steam passing through the dryer duct 300. The relationship and operation of the temperature sensor 400 and the dryer fan 160 will be more fully described later.

Meanwhile, after the washing operation, the washing water contaminated during the washing operation is drained from the tub 130 to the drain pump 170 through the drain tube 171. The drain pump 170 pumps out the contaminated water to the outside through the drain hose 172.

After the contaminated water is discharged, fresh water is introduced into the drum 135 through the water inlet line 181 for a rinsing operation. After the rinsing operation, a spin drying operation is carried out. In the spin drying operation, the drum 135 is rotated at a high speed to apply centrifugal force to the clothes to remove water from the clothes. The removed water is spun out from the drum 135 through a plurality of holes defined in the drum 135, and it is collected at a bottom of the tub 130. The drain pump 170 pumps out the collected water to the outside. After this spin drying operation, a heat drying operation is carried out.

In the heat drying operation, the heater 162 is powered on and heated to a high temperature, and the dryer fan 160 is rotated to draw in air into the dryer duct 300 from between the cabinet 110 and the tub 130. The drawn air is heated by the heater 162 to a high temperature and low humidity. The heated air is flows into the drum 135 along the dryer duct 300 to take moisture from the clothes in the drum 135. After taking moisture from the clothes, the air becomes humid and it is discharged from the drum 135 to the outside through the connecting tub 200 and the air-vent duct 190.

Figure 3:
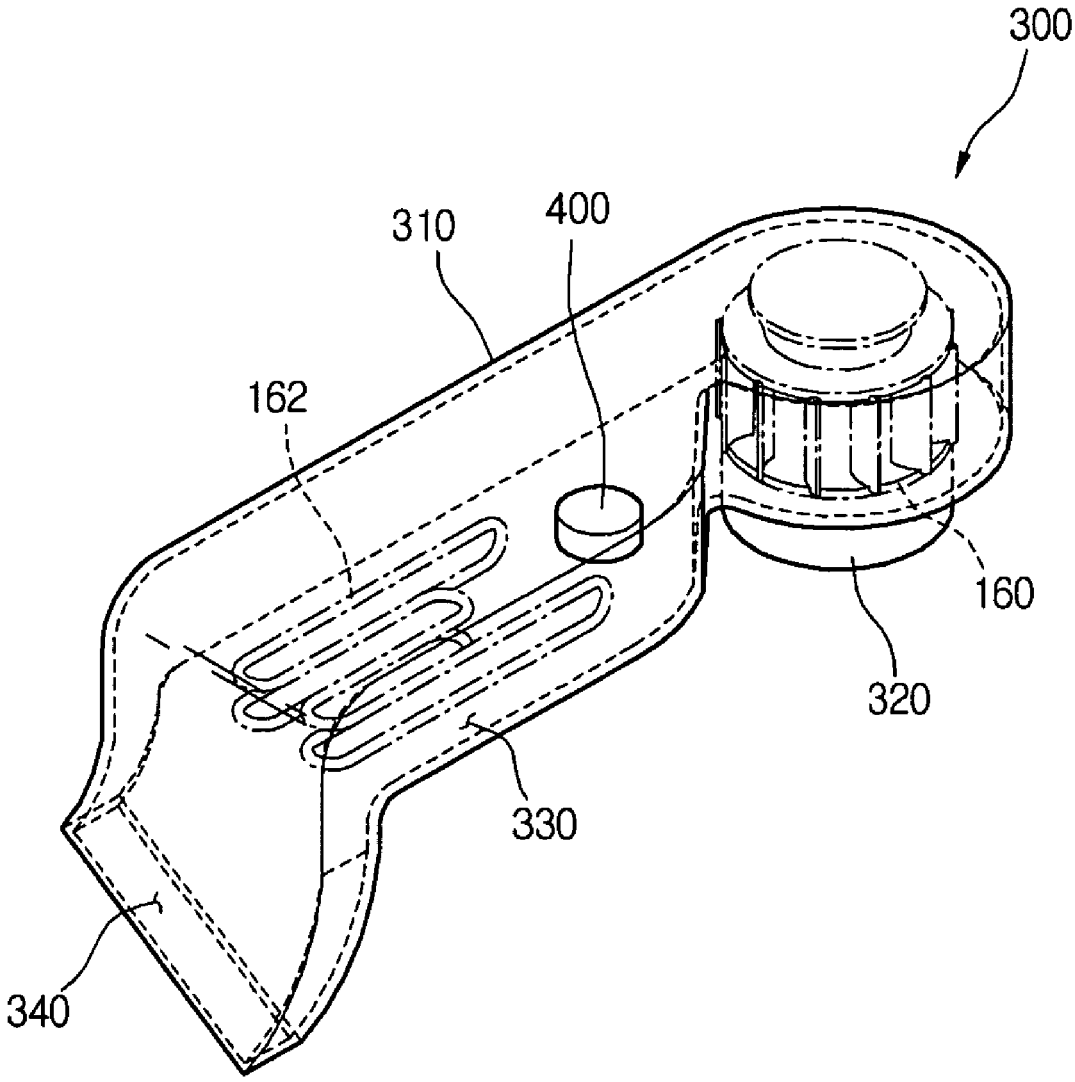
FIG. 3 is a phantom view of a dryer duct according to an embodiment of the present invention.

FIG. 3 is a phantom view of a dryer duct according to an embodiment of the present invention.

Referring to FIG. 3, a dryer duct 300 has a smoothly curved shape with a fan receiving portion 310, an air passage 330, an air outlet 340, and an air inlet 320. The fan receiving portion 310 receives the dryer fan 160, the air passage 330 is extended from the dryer fan 160 to provide an air passage, the air outlet 340 is defined at an end of the air passage 330 to direct air drawn in by the dryer fan 160 toward the tub 130, and the air inlet 320 is extended downwardly from a bottom of the fan receiving portion 310 and formed with a hole to pass air therethrough.

In detail, the heater 162 is mounted in the air passage 330 to heat the air drawn in by the dryer fan 160 before the air flows into the tub 130, and the air passage 330 is bent downwardly at its end for connection with the tub 130. The fan receiving portion 310 has a smooth curvature to minimize airflow resistance. That is, when the dryer fan 160 draws in air in an axial direction and blows the air in a radial direction, the air is smoothly guided by the smooth curvature of the wall of the dryer duct 300, thereby reducing the airflow resistance.

Further, in the dryer duct 300, the temperature sensor 400 is installed between the dryer fan 160 and the heater 162.

When the washing operation is carried out using a hot water, the temperature sensor 400 measures the temperature inside the dryer duct 300 to detect whether hot steam flows reversely to the dryer duct 300 from the drum 135 through the air outlet 340.

In detail, when the temperature measured by the temperature sensor 400 is higher than a reference temperature due to the reverse flow of the hot steam, a controller drives the dryer fan 160 to draw in air from between the cabinet 110 and the tub 130 into the dryer duct 300. The drawn air by the dryer fan 160 prevents the reverse flow of the hot steam.

Further, the dryer fan 160 is controlled to be rotated at a proper speed to prevent the drawn air having a relatively low temperature from flowing into the drum 135 where the clothes are washed with a hot water, thereby maintaining the hot water washing operation without efficiency decrease. For the same purpose, the dryer fan 160 can be intermittently operated or the operating time of the dryer fan 160 can be adjusted.

Figure 4:
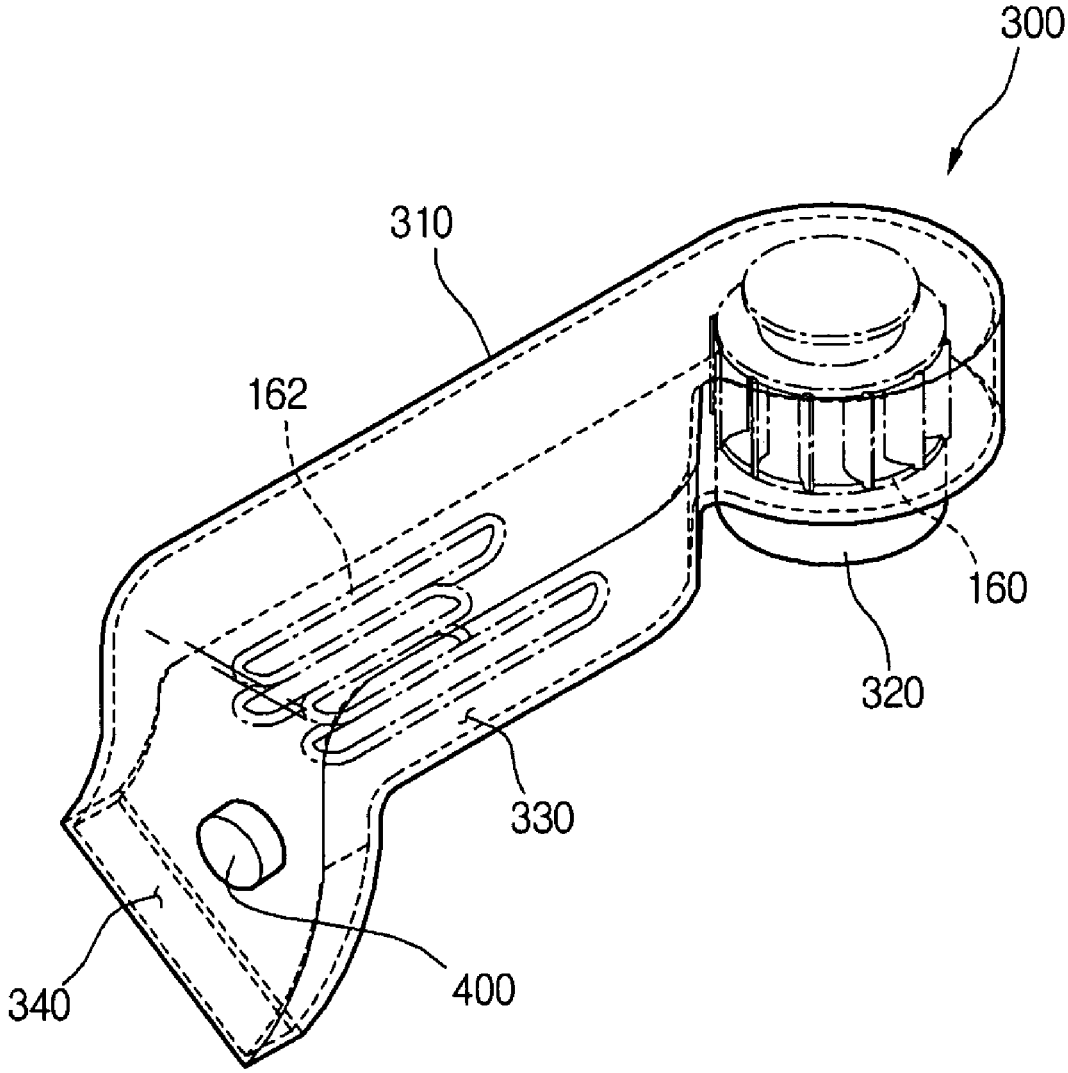
FIG. 4 is a phantom view of a dryer duct according to another embodiment of the present invention.

FIG. 4 is a phantom view of a dryer duct according to another embodiment of the present invention.

Referring to FIG. 4, the temperature sensor 400 is installed in the dryer duct 300 near the air outlet 340, instead of installing it in the dryer duct 300 between the heater 162 and the dryer fan 160 in the previous embodiment.

By placing the temperature sensor 400 near the air outlet 340, the reverse flow of the hot steam can be immediately detected during the hot water washing operation. With a measured temperature by the temperature sensor 400, the operation of the dryer fan 160 is determined in the same manner as the previous embodiment. That is, the temperature sensor 400 sends measured temperature to the controller of the washing machine combined with the dryer 100, and the controller compares the measured temperature with a reference temperature to determine the operation of the dryer fan 160. In detail, if the measured temperature is lager than the reference temperature, the dryer fan 160 is operated to suck surrounding air, and if the measured temperature is not lager than the reference temperature, the dryer fan 160 is not operated. Herein, the temperature sensor 400 may measure the temperature at a regular interval.

A controlling method of the washing machine combined with the dryer 100 will be described in association with the operation of the dryer duct 300 and with reference to the accompanying drawings.

Figure 5:
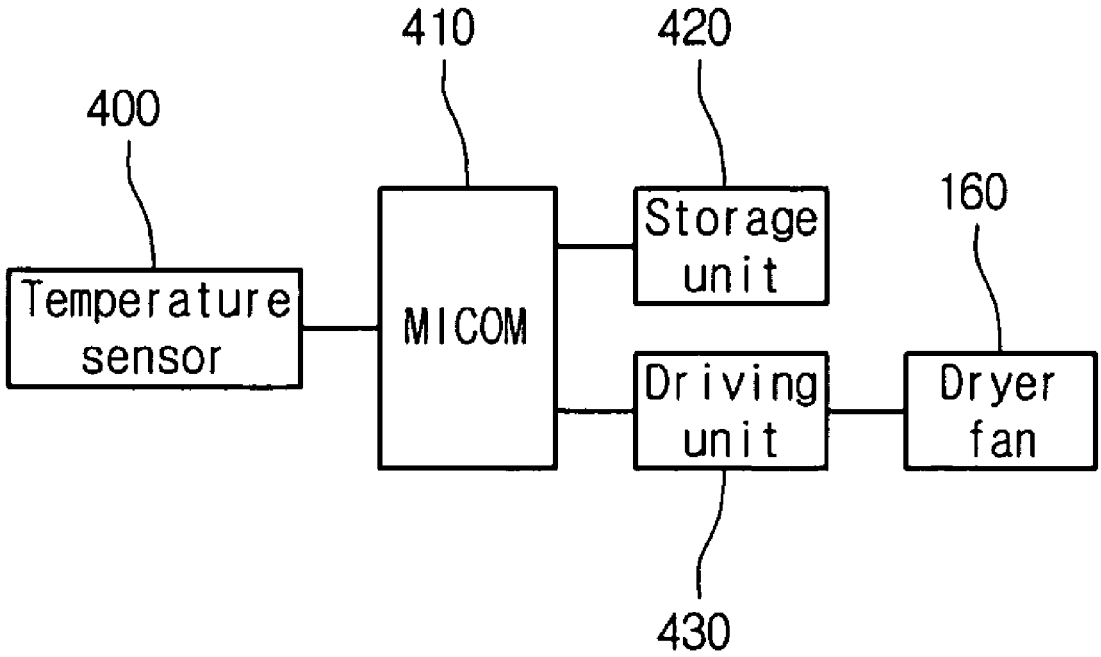
FIG. 5 is a block diagram showing a control configuration of a washing machine combined with a dryer according to the present invention.
Figure 6:
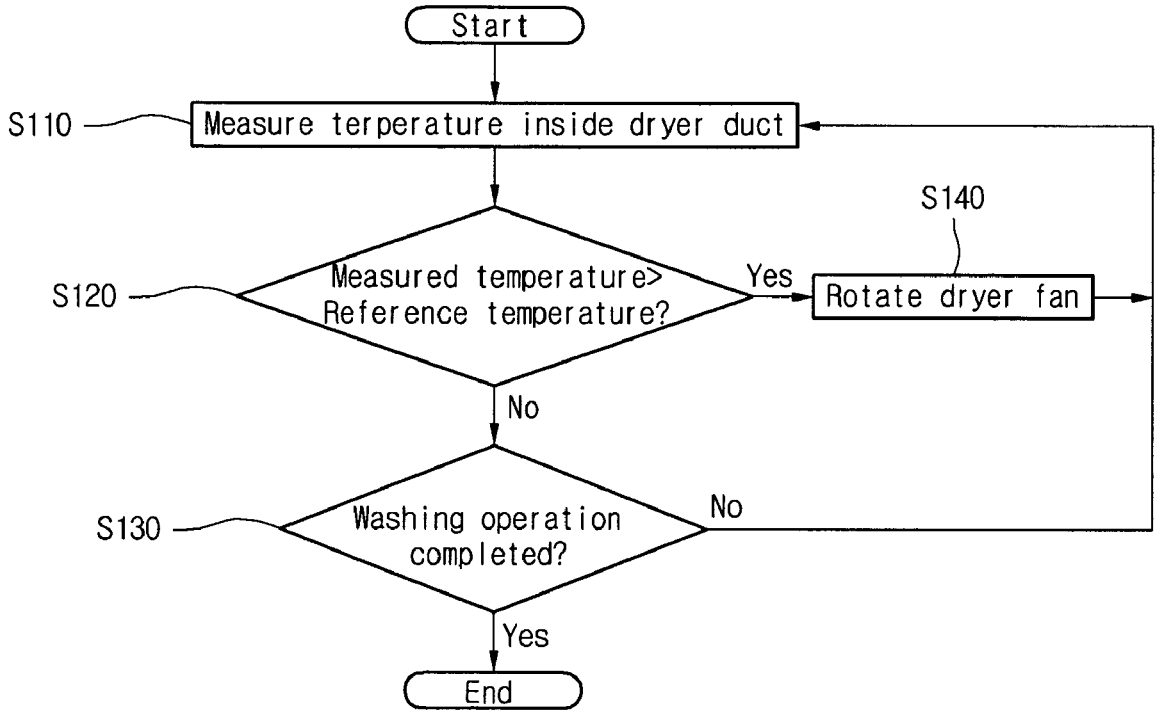
FIG. 6 is a flowchart showing a controlling method of a washing machine combined with a dryer according to the present invention.

FIG. 5 is a block diagram showing a control configuration of a washing machine combined with a dryer according to the present invention, and FIG. 6 is a flowchart showing a controlling method of a washing machine combined with a dryer according to the present invention.

Referring to FIGS. 5 and 6, according to a control configuration of the present invention, the washing machine combined with the dryer 100 includes the temperature sensor 400, the controller such as a microcomputer 410, a storage unit 420, and a driving unit 430. The temperature sensor 400 measures the temperature inside the dryer duct 300, the dryer fan 160 is operated depending on the temperature measured by the temperature sensor 400, the microcomputer 410 receives the measured temperature from the temperature sensor 400 and controls the operation of the dryer fan 160 according to the measured temperature, the storage unit 420 stores a reference temperature for the comparison with the measured temperature, and the driving unit 430 rotates the dryer fan 160 under the control of the microcomputer 410.

In detail, the temperature sensor 400 measures the temperature inside the dryer duct 300 and sends it to the microcomputer 410. The microcomputer 410 compares the measured temperature with the reference temperature stored in the storage unit 420. If it is determined that the measured temperature is larger than the reference temperature, the microcomputer 410 controls the driving unit 430 to rotate the dryer fan 160.

The operation of the dryer fan 160 based on the temperature measured by the temperature sensor 400 will now be more fully described with reference to the flowchart in FIG. 6. Hereinafter, it is assumed that the washing operation of the washing machine combined with the dryer 100 is carried out using a hot water.

First, a user loads clothes in the drum 135 and fills the detergent dispenser drawer 150 with detergent. Then, the user selects operating conditions and presses a start button to supply water to the tub 130.

After that, a washing operation is started.

In operation S110, the temperature sensor 400 installed in the dryer duct 300 is operated to measure the temperature inside the dryer duct 300 and it sends the measured temperature to the microcomputer 410. In operation S120, the microcomputer 410 determines whether the measured temperature is larger than the reference temperature stored in the storage unit 420. If so, the process goes to operation S140 where the microcomputer 410 controls the dryer fan 160 to be rotated. If not, the washing operation is continued without the operation of the dryer fan 160.

In operation S130, it is determined whether the washing operation is completed.

If so, the operation of the temperature sensor 400 is stopped. If not, the process goes back to operation S110 to repeat above-mentioned operations.

Here, since outside air can flow into the drum 135 by the operation of the dryer fan 160 to result in temperature drop inside the drum 135 during the hot water washing operation, the dryer fan 160 may be intermittently operated at a regular interval instead of being continuously operated. Therefore, the temperature drop inside the drum 135 can be prevented. Also, the temperature sensor 400 continually measures the temperature inside the dryer duct 300 at a regular interval during the washing temperature.

In addition, the dryer fan 160 may be properly operated at a lower speed to prevent the outside air from flowing into the drum 135 during the washing operation.

As described above, the hot steam generated in the drum 135 during the hot water washing operation is prevented from reversely flowing to the outside or flowing into the inside of the washing machine combined with the dryer 100. Also, the outside air drawn in by the dryer fan 160 is prevented from flowing into the drum 135 during the hot water washing operation, thereby maintaining the hot water washing operation without temperature drop.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine having a drying function, the washing machine comprising:

a tub to receive water;

a dryer duct installed outside of the tub to introduce ambient air into the tub;

a heater installed in the dryer duct to apply heat to the ambient air;

a temperature sensor installed in the dryer duct to measure temperature inside the tub or temperature inside the dryer duct during a washing operation to detect hot steam flowing reversely into the dryer duct; and a dryer fan installed in the dryer duct to introduce the ambient air into the dryer duct to prevent the hot steam from reversely flowing into the dryer duct when the hot steam is detected in the dryer duct by the temperature sensor, wherein the dryer fan is operated based on the temperature measured by the temperature sensor during the washing operation.

2. The washing machine according to claim 1, wherein the temperature sensor is installed between the heater and the dryer fan.

3. The washing machine according to claim 1, wherein the temperature sensor is installed near an air outlet of the dryer duct, the air outlet directing the air drawn in by the dryer fan toward the tub.

4. The washing machine according to claim 1, wherein the temperature sensor is operated when the washing operation is carried out with hot water in order to detect reverse flow of steam from the tub.

5. The washing machine according to claim 1, wherein the dryer fan is independently operated during a drying operation.

6. The washing machine according to claim 1, wherein the dryer fan is intermittently operated at a regular interval to prevent the ambient air introduced into the dryer duct from flowing into the tub.

7. The washing machine according to claim 1, further comprising a controller to compare a measured temperature to a reference temperature and control operation of the dryer fan according to the result of the comparison.

8. the washing machine according to claim 1, wherein the temperature sensor stops measuring the temperature when the washing operation is completed.

9. The washing machine according to claim 1, further comprising:

a cabinet, the tub installed in the cabinet; and a drum installed in the tub to receive clothes, wherein the ambient air is drawn in from a space between the cabinet and the tub.

10. A washing machine having a laundry drying function, the washing machine comprising:

a tub of which an opening is oriented to a front side of the washing machine;

a dryer duct installed outside of the tub to introduce ambient air to the tub during a drying operation;

a heater installed in the dryer duct to apply heat to the introduced ambient air;

a temperature sensor installed in the dryer duct to measure temperature inside the dryer duct during a washing operation using hot water; and a dryer fan installed in the dryer duct to introduce the ambient air into the dryer duct when hot vapor flows reversely into the dryer duct during the washing operation using hot water.

11. The washing machine according to claim 10, wherein the dryer fan is operated in associated with the temperature sensor during the washing operation using hot water.

12. The washing machine according to claim 11, wherein the dryer fan is operated when the temperature measured by the temperature sensor is higher than a predetermined temperature during the washing operation using hot water.

13. The washing machine according to claim 11, wherein the temperature sensor is positioned closer to the dryer fan than to the tub.

14. The washing machine according to claim 11, wherein the temperature sensor is positioned in the dryer dud such that the steam reversely flowing from the tub passes by the temperature sensor prior to passing by the heater.

* * * * *